United States Patent [19]

Battah

[11] 4,330,237

[45] May 18, 1982

[54] COMPRESSOR AND ENGINE EFFICIENCY SYSTEM AND METHOD

[75] Inventor: Husam Battah, Marysville, Mich.

[73] Assignee: Michigan Consolidated Gas Company, Detroit, Mich.

[21] Appl. No.: 88,785

[22] Filed: Oct. 29, 1979

[51] Int. Cl.[3] ..... F04B 41/06; F04B 49/00

[52] U.S. Cl. ..... 417/2; 417/26; 417/34; 417/42; 417/53; 417/253; 417/275

[58] Field of Search ..... 417/22, 26, 43–45, 417/53, 34, 274–277, 33, 252, 253, 9, 13, 18–20, 42, 2; 123/497

[56] References Cited

U.S. PATENT DOCUMENTS

| | | | |
|---|---|---|---|
| 3,068,796 | 12/1962 | Pfluger et al. | 417/19 X |
| 3,088,656 | 5/1963 | Hartley | 417/274 |
| 4,048,964 | 9/1977 | Kissel | 123/497 X |
| 4,108,574 | 8/1978 | Bartley et al. | 417/20 X |
| 4,137,011 | 1/1979 | Rock | 417/22 |
| 4,171,931 | 10/1979 | Harada | 417/22 |
| 4,178,132 | 12/1979 | Shiraishi et al. | 417/53 X |
| 4,204,808 | 5/1980 | Reese et al. | 417/18 X |
| 4,208,871 | 6/1980 | Riple | 417/18 X |
| 4,227,862 | 10/1980 | Andrew et al. | 417/18 X |

*Primary Examiner*—William L. Freeh
*Assistant Examiner*—Edward Look
*Attorney, Agent, or Firm*—Harness, Dickey & Pierce

[57] ABSTRACT

A method and system for controlling natural gas compressor and engine units. Particularly, the control method provides for the adjustment of the engine speed and compressor loading, so as to minimize the compressing energy required while maintaining a desired gas flow through the pipeline. The control of the engine speed and compressor loading is based in part on an energy quotient value for the unit. The control method further provides for efficient operation during multiple-stage compression, by controlling the interstage pressure. The control method is also adapted to predict impending compressor and engine unit failures. The control system is based upon a digital-type controller which generates control signals in response to changes in the energy quotient value for the unit.

24 Claims, 9 Drawing Figures

COMPRESSOR AND ENGINE EFFICIENCY SYSTEM AND METHOD

BACKGROUND AND SUMMARY OF THE INVENTION

The present invention relates generally to gas engine driven compressor stations which are used to transport natural gas. More particularly, the present invention concerns a method and apparatus for increasing the operating efficiency of natural gas compressor and engine units.

Until recently, the cost of natural gas did not represent a major portion of the daily operating cost for natural gas engine driven compressors such as are used in pipe lines to transport natural gas. However, in the past few years the cost of fuel gas has increased dramatically. The increased cost of natural gas serves to emphasize the necessity to conserve the quantity of natural gas consumed by gas driven compressors which transport the gas to the market. Improving the efficiency of such gas compressor and engine units would not only avoid excessive costs but also a needless drain on the limited natural energy resources of the nation.

Generally speaking, prior art control methods and systems were not concerned with maximizing the energy efficiency of a gas compressor and engine as a unit. The control methods and systems were directed to such concerns as maintaining a desired gas flow, maintaining a certain discharge pressure from the compressor, reducing engine vibration, preventing an excessive differential pressure across the compressor, and maintaining a desired pressure to the consumer. Typically, the speed of the engine driving the gas compressor would be set at the rated speed supplied by the manufacturer. Then variations in the engine speed would be used to effect minor changes in the volume of natural gas being transported or to reduce excessive engine vibration. The torque on the engine was generally not considered as a control parameter, except for preventing an excessive brake mean effective pressure. The compressor load setting would be selected on the basis of the characteristic horsepower curves for the compressor, so that the available horsepower supplied by the engine would be utilized. Examples of prior art methods and systems are taught in U.S. Pat. Nos. 4,119,391, A. Rutshtein et al., Oct. 10, 1978; 3,753,626, R. M. Bacchi, Aug. 21, 1973; 3,716,305, G. Oberlander, Feb. 13, 1973; 3,291,378, J. P. Yarnall, Dec. 13, 1966; 3,251,534, H. E. Strecker, May 17, 1966.

In the present invention, the control parameters for the compressor and engine are selected so as to minimize the use of natural gas, i.e. the compressing energy required, to maintain the desired gas flow through the pipeline. Major losses in efficiency arise from unduly light loading of the compressor, low torque on the engine, low compression ratio, and/or high engine speed. Other factors which affect efficiency are the ambient temperature, the suction gas temperature, gas heating value, and the age or overhaul date of the engine and compressor.

The present invention further provides a control method wherein one or more gas compressor and engine units can be adapted for multiple stage compression operation. These control methods are based upon adjusting various control parameters in response to a change in one or more operating parameters in a gas compressor and engine unit. The control parameters are adjusted so that a maximum energy quotient for the unit is achieved. The use of the energy quotient value also allows for precise predictions of impending unit failures.

Additional features and advantages of the present invention will be apparent from the following disclosure taken in conjunction with the accompanying drawings and appended claims.

DETAILED DESCRIPTION OF THE PREFERRED EMBODIMENT

Figures 1, 2, 3:
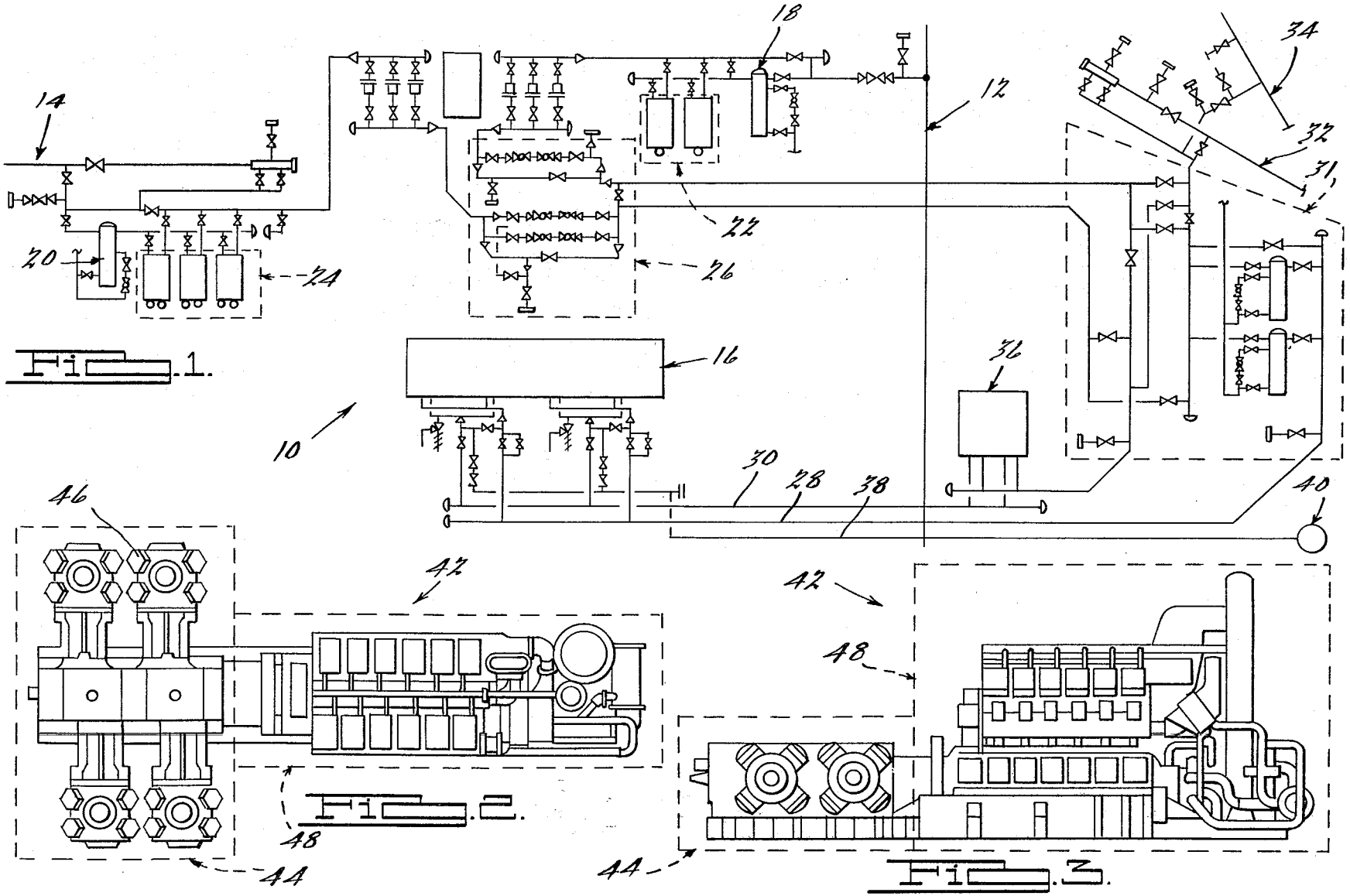
FIG. 1 is a diagrammatic view of a field or gathering gas compressor station.
FIG. 2 is a plan view of a gas compressor and engine unit used at the compressor station in FIG. 1.
FIG. 3 is a side elevation view of the gas compressor and engine unit in FIG. 2.

Referring to FIG. 1, a schematic diagram of a typical field or gathering gas compressor station 10 is shown. Compressor station 10 and the gas compressor and engine units contained therein are described hereinafter to illustrate the application of the present invention in the control of like compressor stations and units. Compressor station 10 is suitable for use in injecting and withdrawing natural gas from two gas fields of a storing capacity on the order of 14.5 and 22.0 billion cubic feet of gas. Line 12 indicates the connecting pipeline for one field, and line 14 indicates the connecting pipeline for another field. Before the natural gas from these fields reaches the compressor building 16, several events must first occur. Scrubbers 18 and 20 remove any liquids or particles that may be present in pipelines 12 and 14, by letting them settle to the bottom of the scrubbers. Heaters 22 and 24 increase the temperature of the gas to prevent freezing the regulators 26. During the winter months when natural gas is being withdrawn from the fields, the pressure in the fields will be substantially greater than the pressure in the gas transmission lines. For example, the maximum pressure limit in these two fields might be 1780 psi; whereas the typical gas transmission line pressure is 800 psi. The regulators 26 provide the necessary pressure drop before the natural gas reaches the transmission line. However, a rapid decrease in pressure also acts to cool the gas at a rate of approximately 7° F. per 100 psi drop in pressure. Hence, the heaters will be needed to protect the regulators from freezing when the pressure in the field is much greater than that in the gas transmission line. Interposed between the heaters and the regulators are meters 22 and 24. These orifice type meters are used to measure the volume of gas flow from the fields.

The compressor building 16 contains two gas compressor and engine units, as indicated by the two sets of pipelines connected to the building. Both the suction gas pipeline 28 leading to the compressor building and the discharge gas pipeline 30 leaving from the compressor building have a 30 inch diameter. These two pipelines are connected through a series of valves and scrubbers 31 to pipelines 32 and 34, which are used to transport natural gas to and from another compressor station. The coolers 36 in discharge gas line 30 are used to reduce the temperature of the gas after compressing when the field is being charged with natural gas. Line 38 has a 4 inch diameter, and connects the compressor building with the blowdown stack 40. The blowdown stack is essentially a vent to atmosphere. It is used to purge the compressors of air before starting, and depressurize the compressors after shutdown. The valves generally designated at 31 also provide a direct connection between regulators 26 and gas transmission pipelines 32 and 34, so that the gas compressor and engine units in building 16 may be bypassed. It should be appreciated that this bypass connection allows the gas to be injected into the fields, or withdrawn from the fields directly from a downstream compressor station.

In operation, this compressor station charges the fields with natural gas during the summer months, and withdraws the gas from the field during the winter months. During the charging or injecting cycle, the fields may be charged from one or both of the compressor and engine units in building 16. Typically both compressor and engine units would be connected in parallel for single-stage operation until the pressure in the fields would reach 1330 psi. Then, under multiple-stage compression, the fields would be fully charged to 1780 psi. Typically, the downstream compressor station units would provide the first stage, and the units at compressor station 10 would provide the second stage. It may also be appreciated that the two units at compressor station 10 could be adapted to be connected in series for multiple-stage compression, rather than utilize the downstream compressor station units for the first stage. During the early withdrawal cycle, the pressure in the fields will be sufficient to transport the gas without resorting to the use of the compressor. Consequently, the valves at 31 will be actuated to provide a direct connection between the regulators and the gas transmission pipelines. When the pressure in the fields is no longer sufficient to transport a desired capacity or volume of gas, the units at compressor station 10 would again be utilized.

Referring to FIG. 2, a plan view of a gas compressor and engine unit 42 is shown. The compressor module 44 contains four identical ends 36, which each house a double-acting piston. The compressor may be characterized as a reciprocating, positive displacement, double-acting mechanism. The engine module 48 is a 12 cylinder, single-acting, reciprocating, V-type internal combustion engine. This engine operates on natural gas, and is rated at 4000 brake horsepower (BHP). FIG. 3 illustrates a side elevation view of this gas compressor and engine unit. The overall length of this unit is 39 ft., 7 in., the maximum width across the compressor ends is 18 ft., 8 in., and the maximum height at the engine is 15 ft., 4 in.

The two gas compressor and engine units at compressor station 10 are similar to the unit shown in FIGS. 2 and 3. The primary difference is that the engine modules at compressor station 10 contain 8 cylinders, and are each rated at 2000 BHP.

Figure 4:
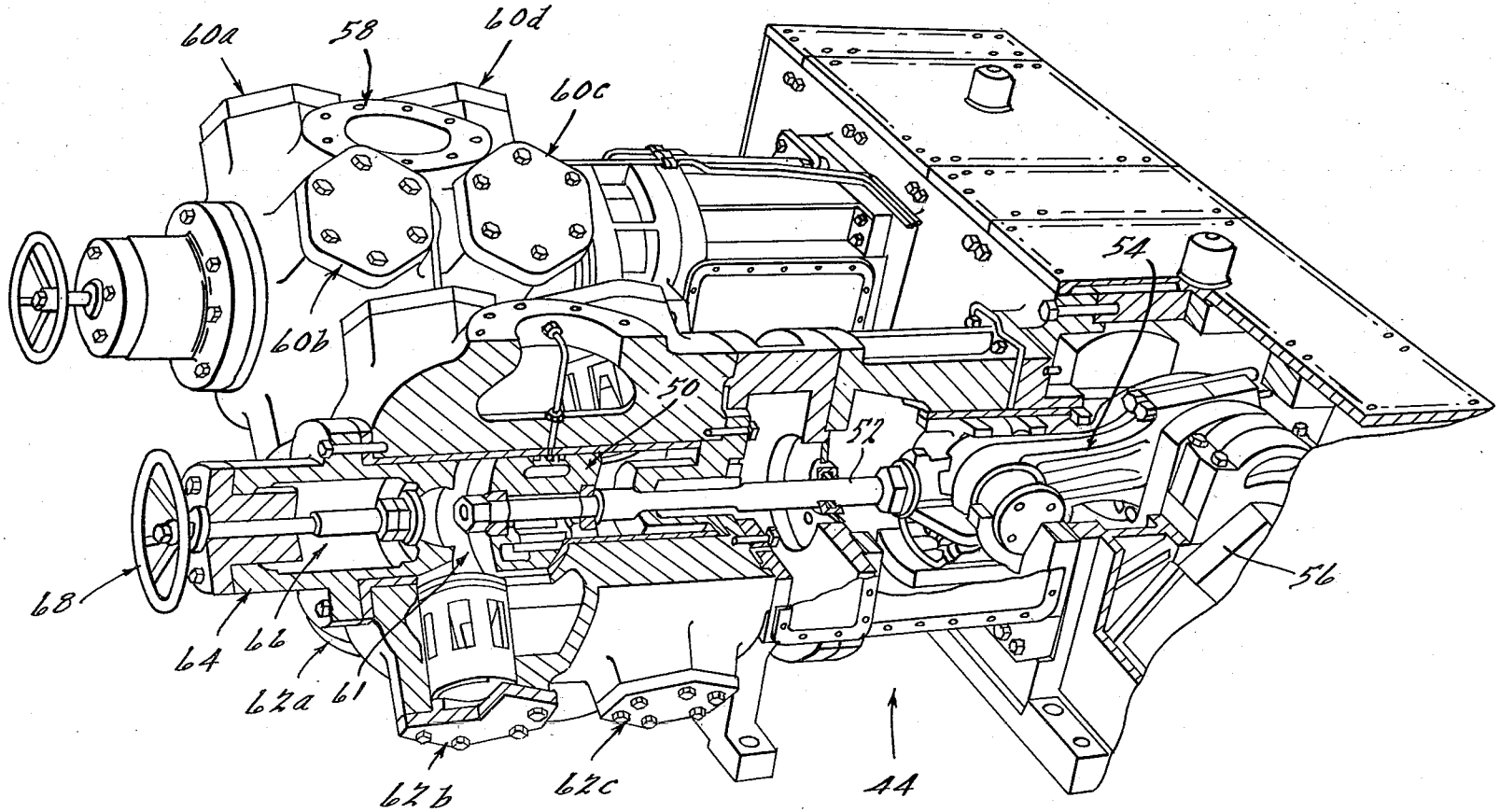
FIG. 4 is a fragmentary cut-a-way perspective view of a gas compressor of FIGS. 2 and 3.

Referring to FIG. 4, a fragmentary cut-a-way prospective view of the compressor module 44 is shown. Each compressor cylinder end 46 contains a single double-acting piston 50. Piston rod 52 is attached to piston 50 at the cylinder head end, and is attached to connecting rod 54 at the crank end. Connecting rod 54 is secured to crankshaft 56, which is in turn coupled to the engine module 48. A suction gas port 58 is located at the top of each compressor cylinder end 46, and an identical port located at the bottom of the cylinder ends is used for the gas discharge. Adjacent to each suction gas port are four plate and poppet type valves 60 (*a, b, c, d*), which control the flow of suction gas into the compression chamber 61 by responding to a pressure differential across the valve. The lower set of four valves 62 (*a, b, c, d*) adjacent to the discharge gas port control the flow of gas from the compression chamber 61. Cylinder head 64 contains a fixed volume pocket 66, which is controlled by handwheel 68. In addition to the manual clearance control shown, automatic control may be effected through the use of pneumatically actuated valves.

In operation, the capacity of gas flow (cubic feet/hour) from compressor module 44 may be controlled by three mechanisms. First, the speed of the engine will of course control the speed at which the pistons 50 reciprocate in the compression chamber 61. This affects the actual volume of gas displaced by the piston as it travels the length of its stroke, which is referred to as the piston displacement (PD). Second, the volume remaining in the compression chamber at the end of a discharge stroke, referred to as the cylinder clearance, may be adjusted by opening and closing pockets, such as fixed volume pocket 66. This affects the volumetric efficiency (VE), which is the ratio of the compression chamber capacity to the actual volume displaced by the piston. Third, the number of compressor ends 46 may be varied or an end may be changed to single-acting operation, by the use of unloaders (not shown) attached to the suction valves 60 (*a, b, c, d*). The unloaders act to hold the suction valves open, and thereby prevent the gas from being discharged from the compressor. For example, when piston 50 moves to the left (cylinder head end), valves 60*c* and *d* would be opened to allow the gas to fill the portion of the compression chamber. At the cylinder head end, valves 60*a* and *b* would be closed to prevent the gas from escaping back into the suction gas port, and valves 62*a* and *b* would be open to allow the gas to be discharged from the cylinder head portion of the compression chamber, to the discharge gas port. If an unloader opened either suction valves 60*a* or *b*, the gas in the compression chamber would preferentially escape back into the suction gas port rather than through discharge valves 62*a* and *b*, due to the greater pressure at the discharge gas port than at the suction gas port. In this situation the compressor end would be characterized as single acting, as only the portion of the compression chamber nearest the crank end would be pumping gas through the compressor. Similarly, if all of the suction valves 60 (*a, b, c, d*) were unloaded, no gas would be pumped through the compressor end even though the piston would be reciprocating at the same speed.

As an example of the foregoing, Table 1 illustrates the theoretical volume of gas displaced by the pistons as a function of various compressor loadings, for one of the gas compressor and engine units at compressor station 10. These values were calculated at the rated engine speed (600 rpm) of the engine module. Although there are four compressor ends 46 in compressor module 44, the term "ends out" in Table 1 encompasses single as well as double-acting piston operation. In other words, the availability of single-acting operation provides in effect eight possible compressor ends which may be utilized to pump natural gas through the compressor. As indicated in the Table, the gas compressor and engine unit at compressor station 10 has been adapted to include one large (L) and two small (S) pockets for each compressor end 46. These pockets are attached to the compressor cylinder head, and are pneumatically actuated. The large pockets have a volume of 1027 cubic inch, and the small pockets each have a volume of 300 cubic inch. As stated previously, the number of pockets open or closed control the clearance volume left in the compression chamber after the piston has completed a compression stroke. As indicated in the table, this volume may even exceed the volume of gas displaced by the piston stroke. Although the cylinder clearance does not affect the volume of gas displaced by the pistons, it does affect the volume of gas flowing from the compressor. As will be described later, the piston displacement is only one of several terms defining the capacity (Q) of gas flow from the compressor. The cylinder clearance also affects the torque on the engine. and in combination with the speed of the engine, the cylinder clearance provides an effective control of the torque.

TABLE I

THEORETICAL PISTON DISPLACEMENT AS A FUNCTION OF COMPRESSOR LOADING

| ENDS OUT | POCKETS OPEN | COMPRESSOR PISTONS DISPLACEMENT CF/HR | AVERAGE CYLINDERS CLEARANCE % |
|---|---|---|---|
| 0 | 0 | 134,550 | 30.67 |
| 0 | 1-S | " | 36.32 |
| 0 | 2-S | " | 39.98 |
| 0 | 4-S | " | 49.29 |
| 0 | 6-S | " | 58.60 |
| 0 | 8-S | " | 67.91 |
| 0 | 6S-1L | " | 74.54 |
| 0 | 8S-1L | " | 83.85 |
| 0 | 6S-2L | " | 90.48 |
| 0 | 8S-2L | " | 99.79 |
| 0 | 6S-3L | " | 106.42 |
| 0 | 8S-3L | " | 115.73 |
| 0 | 6S-4L | " | 122.35 |
| 0 | 8S-4L | " | 131.60 |
| 1 | 0 | 116,698 | 32.59 |
| 1 | 1-S | " | 37.98 |
| 1 | 2-S | " | 43.35 |
| 1 | 4-S | " | 54.08 |
| 1 | 6-S | " | 64.82 |
| 1 | 8-S | " | 75.55 |
| 1 | 6S-1L | " | 83.19 |
| 1 | 8S-1L | " | 93.93 |
| 1 | 6S-2L | " | 101.57 |
| 1 | 8S-2L | " | 112.30 |
| 1 | 6S-3L | " | 119.95 |
| 1 | 8S-3L | " | 130.68 |
| 2 | 0 | 98,846 | 35.25 |
| 2 | 1-S | " | 41.58 |
| 2 | 2-S | " | 47.92 |
| 2 | 4-S | " | 60.59 |
| 2 | 6-S | " | 73.27 |
| 2 | 8-S | " | 85.95 |
| 2 | 6S-1L | " | 94.97 |
| 2 | 8S-1L | " | 107.64 |
| 2 | 6S-2L | " | 116.66 |
| 2 | 8S-2L | " | 129.34 |
| 3 | 0 | 80,993 | 39.05 |

TABLE I-continued

THEORETICAL PISTON DISPLACEMENT AS A FUNCTION OF COMPRESSOR LOADING

| ENDS OUT | POCKETS OPEN | COMPRESSOR PISTONS DISPLACEMENT CF/HR | AVERAGE CYLINDERS CLEARANCE % |
|---|---|---|---|
| 3 | 1-S | " | 46.78 |
| 3 | 2-S | " | 54.52 |
| 3 | 4-S | " | 69.98 |
| 3 | 6-S | " | 85.45 |
| 3 | 8-S | " | 100.92 |
| 3 | 6S-1L | " | 111.93 |
| 3 | 8S-1L | " | 127.39 |
| 4 | 0 | 63,137 | 45.00 |
| 4 | 1-S | " | 54.92 |
| 4 | 2-S | " | 64.84 |
| 4 | 4-S | " | 84.68 |
| 4 | 6-S | " | 104.52 |
| 4 | 8-S | " | 124.36 |

In describing the present invention, a particular nomenclature will be utilized. Although this nomenclature is more or less standard to those skilled in the art, a glossary providing definitions of the nomenclature is set forth in Table 2 for convenience and clarity.

TABLE 2

GLOSSARY

| | |
|---|---|
| $A_h$ | = area of the piston head (sq. in.) |
| $A_r$ | = area of the piston rod (sq. in.) |
| BHP | = brake horsepower |
| BTU | = British thermal unit |
| CF/HR | = cubic feet per hour |
| $C_v$ | = cylinder clearance volume |
| $E_i$ | = ideal energy required to compress natural gas (BTU/SCF) |
| E.Q. | = energy quotient |
| $F_h$ | = fuel heating value (BTU/SCF) |
| Input | = energy needed to operate the engine (BTU/HR) |
| k | = ratio of specific heats |
| L | = length of piston stroke (in.) |
| LHV | = lower heating value of fuel gas (BTU/SCF) |
| MM-BTU/HR | = millions of BTU per hour |
| N | = engine speed (rpm) |
| Output | = $Q \times Z_s \times E_i$ (BTU/HR) |
| overall efficiency | = compressor cylinder efficiency × mechanical efficiency |
| P. D. | = piston displacement (CF/HR) |
| $P_d$ | = discharge gas pressure (PSIG) |
| $P_s$ | = suction gas pressure (PSIG) |
| Q | = capacity of gas flow from the compressor (SCF/HR) |
| $R_c$ | = compression ratio = $P_d/P_s$ |
| SCF/HR | = standard cubic feet per hour |
| s.g. | = specific gravity |
| T | = torque |
| $t_s$ | = suction gas temperature (°F.) |
| V.E. | = volumetric efficiency |
| $V_e$ | = volume of fuel gas consumed by engine per hour (SCF/HR) |
| Z | = compressibility of gas |

In order to evaluate the performance of a gas compressor and an engine as a unit, the concept of an energy quotient (E.Q.) was developed. The energy quotient is essentially the thermal efficiency of the gas compressor and engine unit, and is generally defined as $$E.Q. = \frac{\text{Output (BTU/HR)}}{\text{Input (BTU/HR)}} \quad (1)$$

The Output is the theoretical energy required to compress a certain volume of gas between given pressure limits, and the Input is the energy consumed by the engine driving the compressor.

Before proceeding to set forth the equations defining the Output and Input, several terms used in these equations will first be described. The volume of gas displaced per hour by a double acting piston is defined by $$P.D.\ (SCF/HR) = ((2A_h - A_r) \times L \times N)/28.8, \quad (2)$$

at standard conditions of 14.7 (PSIG) gas pressure and 60° (F) gas temperature. The volumetric efficiency (V.E.) is the ratio of actual cylinder or compression chamber volume to piston displacement (P.D.), and is defined as $$V.E. = 0.98 - C_v\,(R_c^{1/k} - 1), \quad (3)$$

where the ratio of specific heats (k) for natural gas is approximately 1.3.

Figure 5:
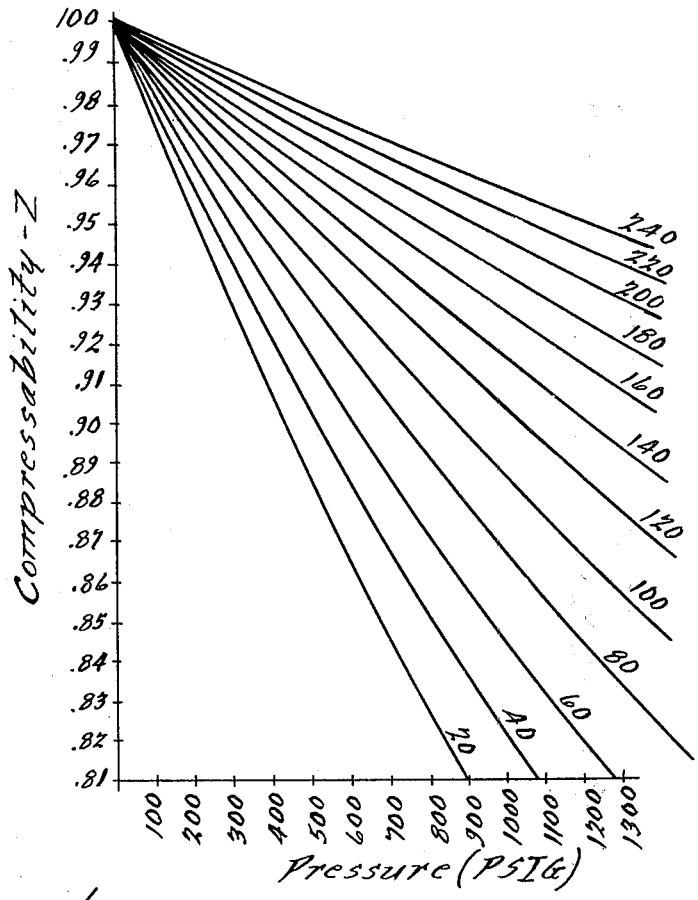
FIG. 5 is a graph of the compressibility of natural gas as a function of gas pressure and temperature.

The compressibility of gas (Z) is a dimensionless factor which varies with temperature and pressure. FIG. 5 illustrates a graph of the theoretical compressibility of nature gas, based on a specific gravity of 0.6. The theoretical volume per hour of gas flow from the compressor, capacity (Q), is defined by $$Q(SCF/HR) = P.D. \times V.E. \times (\text{Actual } N/\text{Rated } N) \times (P_s/14.7) \times (1/Z_s). \quad (4)$$

Figure 6:
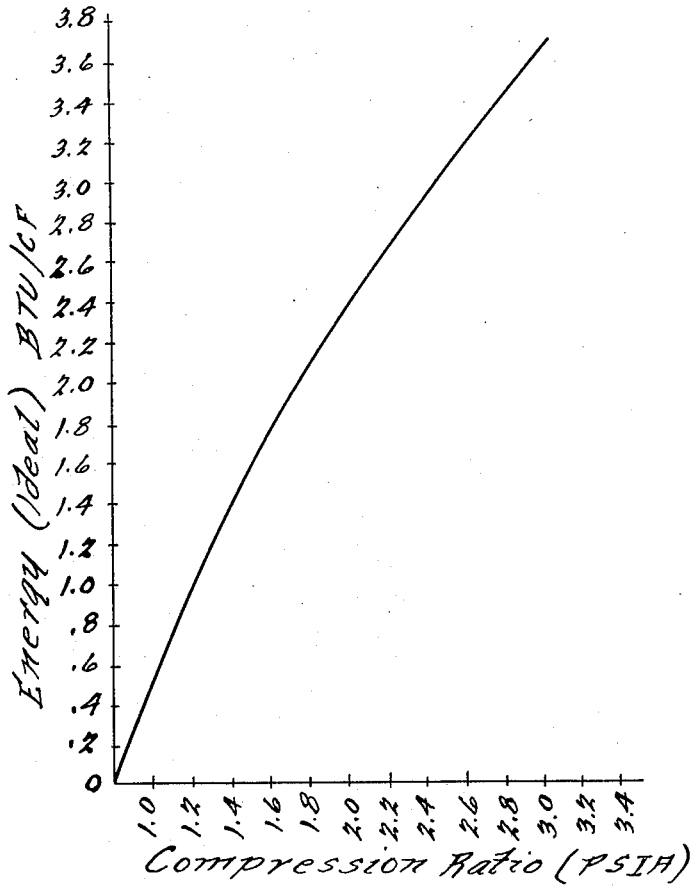
FIG. 6 is a graph of the ideal thermal energy required to compress natural gas as a function of the compression ratio.

The final term necessary to define the Output of the compressor is the ideal thermal energy ($E_i$) required to compress the gas at standard temperature and pressure conditions. FIG. 6 illustrates a graph of the ideal (frictionless adiabatic) energy required as a function of the compression ratio ($R_c$). This curve was calculated for natural gas with a specific gravity of 0.6 and a k of 1.3. The Output may now be defined as $$\text{Output } (BTU/HR) = Q \times Z_s \times E_i, \quad (5)$$

where $Z_s$ is the compressibility of the suction gas. The Input is defined as $$\text{Input } (BTU/HR) = V_e\,(SCF/HR) \times F_h\,(BTU/SCF), \quad (6)$$

where the fuel heating value ($F_h$) is assumed to be the lower heating value (LHV) of the fuel gas.

Although the energy quotient provides an excellent criterion by which the performance of a gas engine and compressor unit may be evaluated, it does not supply all of the information necessary to control the operation of the unit in accordance with the present invention. The brake horsepower (BHP) required from the engine and the percent torque (T) on the engine are also needed; and are calculated as follows.

$$\text{BHP} = \frac{\text{Output (BTU/HR)}}{2545\ (\text{BTU/BHP-HR}) \times \text{Overall Efficiency}} \quad (7)$$

Figure 7:
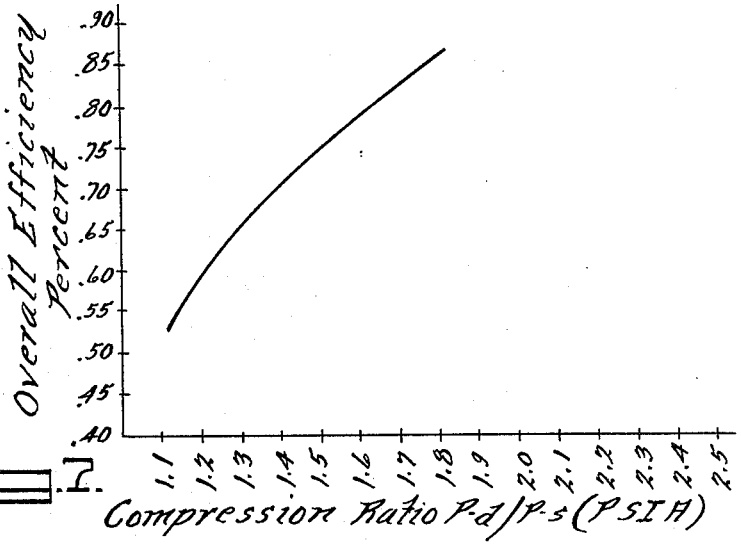
FIG. 7 is a graph of the overall efficiency of a typical gas compressor and engine unit for the gas compressor station in FIG. 1.

The overall efficiency is the compressor cylinder efficiency multiplied by the mechanical efficiency of the unit. FIG. 7 illustrates a graph of the overall efficiency as a function of the compression ratio for a particular unit:

$$\text{BHP \%} = \frac{\text{Calculated Actual BHP}}{\text{Rated BHP}} \times 100 \quad (8)$$

-continued $$T\,\% = \text{BHP \%} \times \frac{\text{Rated } N\ (\text{rpm})}{\text{Actual } N\ (\text{rpm})} \quad (9)$$

The practical application of the above principals in the control of one or more gas compressor and engine units will now be described. One of the primary concerns in the operation of a compressor station or unit is the amount of gas (volume/hour) being transferred through the pipeline. During the time when gas is being stored in a field for future use, the amount of gas being injected into the field would normally not be considered critical. In fact, this would generally be dependent upon the geological formation of the field. However, when gas is being withdrawn from the field to meet a required demand by the consumer, the maintenance of a constant volume of gas flow from the field is quite important. This is especially true in the winter months when natural gas is being used to heat many residential homes. Consequently, the situation may arise where the station or unit is adjusted to move the gas in the most efficient manner, even though the volume of gas transferred is somewhat reduced. Further, the situation may arise where the volume of gas being transferred is controlling, and the efficiency of the station or unit can only be optimized within this constraint.

In terms of the field compressor station 10 illustrated in FIG. 1, the following basic control options exist: one unit may be utilized to transfer gas; both units may be combined in parallel; both units may be combined in series (multiple-stage compression); the gas pressure in the fields may be sufficient to transfer gas from the field without the units; or the down stream station may be utilized to transfer gas to or from the fields (single or multiple-stage).

In the situation where one gas compressor and engine unit is utilized and the volume of gas flowing from the compressor is not critical, then in accordance with the present invention the unit should be operated so that the energy quotient (E.Q.) is maximized. This is accomplished through adjustments of the speed of the engine (N) and the loading on the compressor. As described previously, compressor loading adjustments are performed by varying the number of compressor ends 46 being utilized to pump the gas, and varying the cylinder clearance volume ($C_v$).

As the engine speed and compressor loading are the only two parameters which may be directly controlled, they will be referred to as the "control parameters". The remaining parameters which may be physically sensed during the operation of a unit, will be referred to as the "operating parameters". These include the suction gas pressure ($P_s$), the discharge gas pressure ($P_d$), the suction gas temperature ($t_s$), the capacity of gas flow from the compressor (Q), the volume of fuel gas consumed by the engine ($V_e$), and the lower heating value of the fuel gas (LHV).

Figure 8:
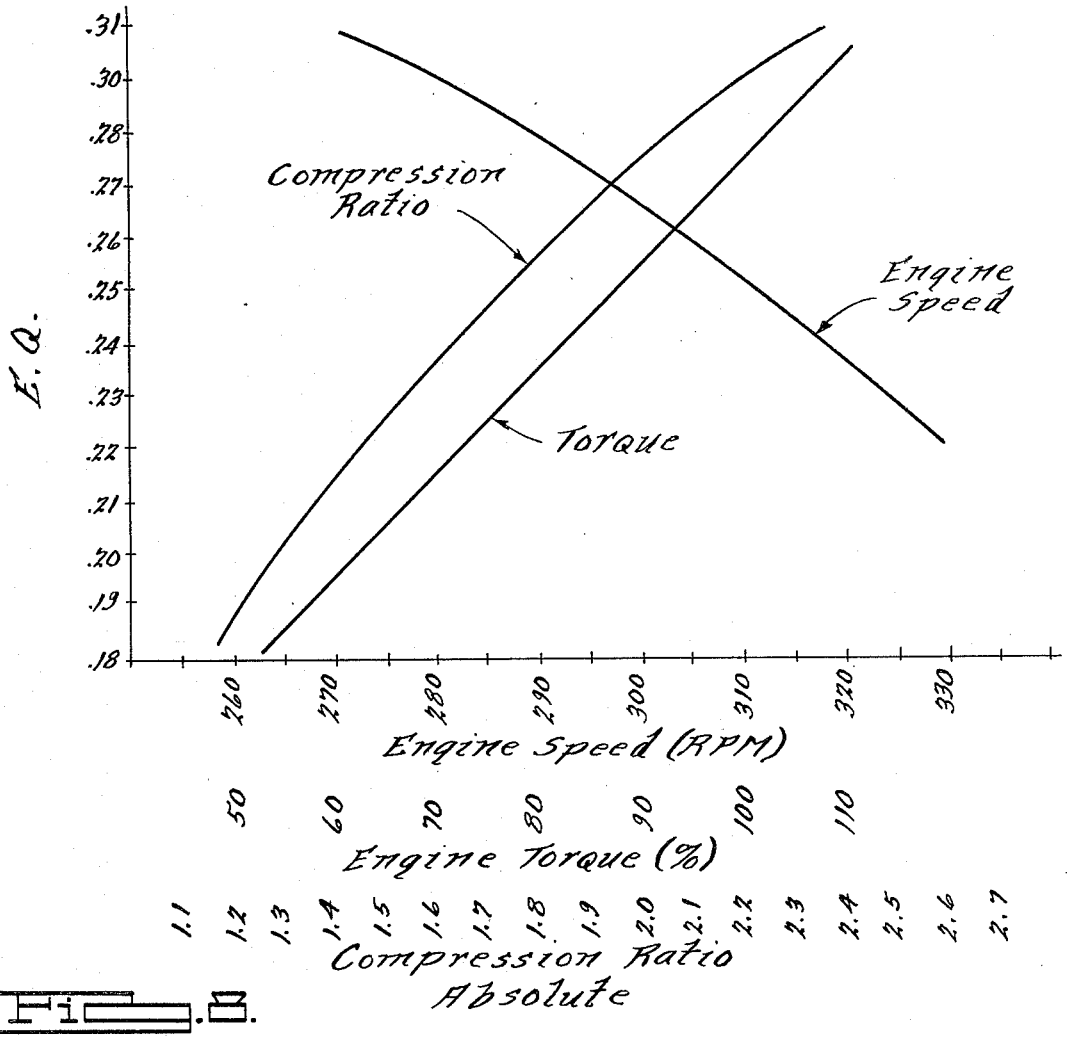
FIG. 8 is a composite graph depicting the relationship between various parameters and the energy quotient for a typical gas engine and compressor unit.
Figure 9:
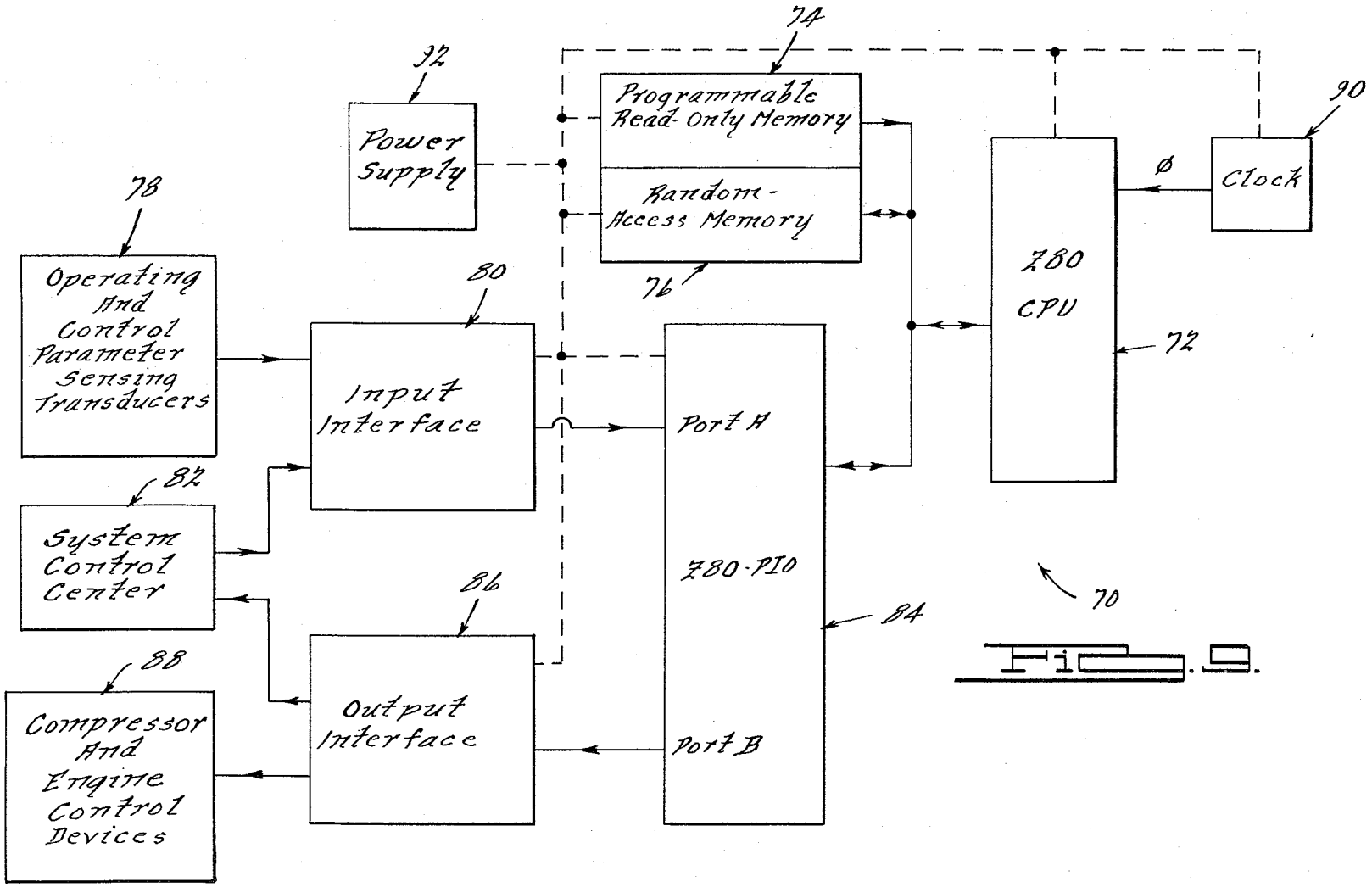
FIG. 9 is a block diagram showing the various elements and connections thereto for an electronic controller for use in accordance with this invention.

The effect of the engine speed (N), the engine torque (T), and the compression ($R_c$) on the energy quotient for a unit is illustrated in FIG. 8. This composite graph was taken from experimental data on another type of gas compressor and engine unit than that disclosed herein. Each curve was based on maintaining the other two parameters (N, T, or $R_c$) constant. It may be observed that the energy quotient decreases when the engine speed increases. As the rated speed for this unit is 330 (rpm), it is apparent that the engine should be operating at a lower speed to maximize the efficiency of the unit. For the purpose of the present invention, the effect of the engine speed on the efficiency of the engine itself is unimportant, and should be distinguished from the efficiency of the compressor and engine as a unit.

With reference to the torque on the engine, it may be observed that the energy quotient increases linearly with an increasing torque. From this curve it is apparent that the unit operates most efficiently when the torque on the engine is approximately 100% of the rated torque. As stated previously, the torque on the engine is controlled by the engine speed and the compressor loading. Therefore, a gas compressor and engine unit should be controlled so that the compressor loading maximizes the engine torque while maintaining the engine speed at the minimum value necessary to pump the desired capacity of natural gas through the compressor.

The third curve in FIG. 8 illustrates the relationship between the compression ratio ($R_c$) and the energy quotient of the unit. As indicated, the compression ratio has a substantial effect on the energy quotient. However, the compression ratio is one of the last controllable parameters in the operation of the unit. For example, when natural gas is being withdrawn from the field, the suction gas pressure ($P_s$) at the compressor will be dependent upon the gas pressure in the field as well as the capacity of gas being drawn from the field.

The compression ratio is also important because it is the only sensed parameter which changes during the normal operation of a gas compressor and engine unit. However, the variation in this one parameter also affects the compressibility of the gas (Z), the volumetric efficiency (V.E.), the ideal energy required to compress the gas ($E_i$) and the overall efficiency of the unit. Variations in these factors in turn affect the capacity of gas flow (Q), and the energy quotient (E.Q.). Consequently, in order to operate a unit so that the energy quotient is maximized, the compression ratio must be monitored or sampled at determinable intervals. Thus, when the compression ratio changes, the control parameters may be adjusted in response to this change to either attempt to maintain the original energy quotient, or achieve the highest energy quotient under the particular circumstances. It should also be noted that when either of the control parameters are adjusted, the compression ratio will again be changed. Therefore, this adjustment process will typically be an iterative one.

In the situation where a specific capacity of gas flow from the compressor must be maintained, the following exemplifies the proper control steps to be taken. Assuming that the unit is withdrawing gas from the field and the suction gas pressure decreases, then the capacity (Q) will also decrease. First, the engine torque (T) must be examined in order to determine if it is below the rated torque for the engine. If the torque may be increased, then the option exists to increase the engine speed or the compressor loading. In accordance with the present invention, it is preferred that the loading on the compressor be adjusted before adjusting the speed on the engine. After the loading has been increased by a fixed increment, such as closing a pocket or adding another compressor end, then the system must be allowed time to stabilize. This is because the compression ratio will be changed by the increased capacity (Q). After this time period, the torque must be determined again. If the torque is still below the rated torque, the compressor loading may be increased another step. This process is repeated until the desired capacity is obtained, or the compressor is at maximum loading. If the desired capacity cannot be achieved at maximum loading, then the engine speed may be increased. Again, the increase in engine speed should not be such as to increase the engine torque beyond the maximum torque for the unit. Where the desired capacity is achieved at a compressor loading less than the maximum available, then the compressor loading and engine speed should be adjusted so that the torque on the engine is maximized and the engine speed is at the minimum value necessary to pump the desired capacity.

In the situation where two gas compressor and engine units are combined in parallel, the units may be operated essentially independent of one another. However, when the units are combined in series for multiple-stage operation, the units are considered together under the present invention. Rather than optimize the efficiency of one unit or the other, the units are controlled so that the energy efficiency for the sum of both units is optimized. Particularly, the inter-stage pressure is controlled, while still maintaining an essentially equal capacity of gas flow from each unit. By controlling the inter-stage pressure, the compression ratio for each unit may be controlled. Thus, where two similar units are utilized, the inter-stage pressure would be adjusted so that the compression ratio for each unit would be approximately equal. However, where the units are not matched, this adjustment would be dependent upon the particular units used. For example, one unit may have a relatively low energy quotient at a certain compression ratio, whereas another unit would have a higher energy quotient at a lower compression ratio. Thus, in this situation the inter-stage pressure would be adjusted so that the relatively inefficient unit would have a higher compression ratio than the more efficient unit.

The above control method may also be adapted to predict impending gas compressor and engine unit failures. This would be accomplished by comparing the current energy quotient value for the unit with a standard or base value energy quotient, determined from curves similar to those in FIG. 8. When the difference between these energy quotient values exceeds a predetermined value, the unit would then be examined for defects. With respect to the compressor module, such defects could include worn out cylinder rider bands or rings, worn rod packings, or defective suction or discharge valves. In the engine module, such defects could be related to the engine timing, the spark plugs, exhaust or intake valves, the power piston rings, or the turbocharger. One method of determining whether a defect exists in the compressor module or in the engine module is to calculate the current energy quotient value on the basis of the actual capacity (Q) of gas flow from the compressor. One or more elbow meters, standard in the art, would be connected to the outlet pipeline from the compressor to sense the actual capacity. By comparing the energy quotient value based on the calculated capacity with the energy quotient value based on the sensed capacity, the general location of the defect may be determined. For example, if the difference between these values is small, then the problem would be with the engine module, as the compressor would be pumping the capacity of gas it should be pumping.

The above control methods may also be embodied in an automatic controller device to achieve and maintain the maximum energy quotient for one or more gas compressor and engine units. It may be appreciated by one skilled in the art that such a device could be constructed from analog or digital circuitry. However, a digital controller based upon a microprocessor unit will be described here. FIG. 10 illustrates a block diagram of a microprocessor based controller 70 according to the present invention. The central processing unit 72 may be of a type standard in the industry, such as the Zilog Z80 microprocessor chip. The programmable read-only-memory 74 will contain the program for directing the operation of the controller device 70. The random access memory 76 would be used to store the various parameter values being sensed by input transducers 78, and store the results of the calculations incident to the control of the gas compressor and engine unit. Input interface 80 is used to receive the signals from input transducers 78 and system control center 82 for signal processing before being sent to parallel input-output port 84. Such signal processing would generally analog to digital conversion and digital signal multiplexing. Examples of typical interfacing schemes standard in the art may be found in Automated Process Control Systems: Concepts and Hardware, Prentice-Hall, Inc., R. P. Hunter, 1978. Input-output port 84 is also used to transmit signals to output interface 86, which essentially provides the reverse function of input interface 80. The signals from output interface 86 may then be sent to system control center 82, or to control devices 88. System control center 82 is used to provide operator access to controller device 70, and would include a keyboard, a printer, and a cathode ray tube display. Control devices 88 would be used to control the engine speed, compressor pocket clearance, and compressor pneumatic-type unloader valves. Oscillator/clock 90 is used to provide the timing signals necessary to operate central processing unit 72. Power supply 92 is used to provide the electrical power needed to operate control processing unit 72, memories 74 and 76, clock 90, input-output port 84, and interfaces 80 and 86.

In operation, control commands such as to initiate the operation of the gas compressor and engine unit may be entered into controller device 70 via the keyboard in system control center 82. Such commands may include the specification of a desired capacity (Q), percent rated torque, or energy quotient; or a range thereof within which the controller may operate. The central processing unit would then compare the capacity, torque, and energy quotient values with the desired values stored in memory 76. Control signals would then be generated and sent to interface 86, where the control parameters would be adjusted in response to the above comparison.

While it will be apparent that the preferred embodiments of the invention disclosed are well calculated to fulfill the objects above stated, it will be appreciated that the invention is susceptible to modification, variation and change without departing from the proper scope or fair meaning of the subjoined claims.

I claim:

1. A method of controlling a gas compressor and engine unit, the steps comprising:

(a) sensing the values of a set of operating and control parameters at determinable intervals;

(b) determining an energy quotient for said unit from said operating and control parameters;

(c) adjusting at least one control parameter in response to a change in said energy quotient, so that said energy quotient for said gas compressor and engine unit is substantially maximized.

2. The method according to claim 1 wherein one of said control parameters is a compressor loading.

3. The method according to claim 1 wherein one of said control parameters is an engine speed.

4. The method according to claim 1 wherein said operating parameters include a suction and discharge gas pressure, a lower heating value of a fuel gas, a rate of fuel gas consumption by said engine, a suction gas temperature, and a capacity of gas flow from said compressor.

5. The method according to claim 1 wherein said adjustment further provides a desired capacity of gas flow.

6. A method of increasing the efficiency of a gas compressor and engine unit, the steps comprising:

(a) adjusting a compressor loading and engine speed so that a desired capacity of gas flow is achieved;

(b) readjusting said compressor loading and said engine speed after a determinable interval so that an energy quotient for said gas compressor and engine unit is substantially maximized, while maintaining said desired capacity of gas flow.

7. The method according to claim 6 wherein said adjustment minimizes the required engine speed necessary to achieve said desired capacity of gas flow.

8. The method according to claim 6 wherein said adjustment maximizes the required compressor loading necessary to achieve said desired capacity of gas flow.

9. A method of controlling an engine speed and a compressor loading for a gas compressor and engine unit, the steps comprising:

(a) sensing a suction and a discharge gas pressure from said compressor;

(b) determining a compression ratio from said suction and discharge pressure;

(c) adjusting said engine speed and compressor loading in response to a change in said compression ratio, so that an energy quotient for said unit is maximized.

10. A computer-implemented method of controlling a gas compressor and engine unit, the steps comprising:

(a) calculating an initial energy quotient from a selected set of operating and control parameter values;

(b) storing said energy quotient value in a memory of a computer;

(c) initiating the operation of said gas compressor and engine unit;

(d) sensing at determinable intervals said operating and control parameter values;

(e) calculating a new energy quotient from said sampled parameter values;

(f) comparing said new energy quotient with said initial energy quotient;

(g) modifying at least one of said control parameters in response to a difference between said energy quotient values.

11. The computer-implemented method according to claim 10 wherein said modification minimizes said difference between said energy quotient values.

12. The computer-implemented method according to claim 10 wherein said modification maintains a desired capacity of gas flow.

13. The computer-implemented method according to claim 10 wherein one of said control parameters is a compressor loading.

14. The computer-implemented method according to claim 10 wherein one of said control parameters is an engine speed.

15. A controller device for use with a gas compressor and engine unit, comprising:

transducer means for sensing a set of operating and control parameter values;

input interface means for receiving signals from said transducer means;

processing means for determining an energy quotient, for said gas compressor and engine unit, from said operating and control parameter values;

means for comparing said energy quotient with a predeterminable energy quotient in order to control at least one of said control parameters; and output interface means for applying control signals in response to said comparing means.

16. The controller device according to claim 15 wherein said operating parameters include a suction and discharge gas pressure, a suction gas temperature, a rate of fuel gas consumption by said engine, and a lower heating value of said fuel gas.

17. The controller device according to claim 15 wherein said control parameters include a compressor loading and an engine speed.

18. The controller device according to claim 15 wherein said control signals maximize said energy quotient value for said gas compressor and engine unit.

19. A controller device according to claim 15 wherein said control signals minimize a difference between said compared energy quotient values.

20. The controller device according to claim 16 wherein said operating parameters further include a capacity of gas flow from said compressor.

21. The controller device according to claim 20 which includes means for comparing said sensed capacity with a predeterminable capacity of gas flow from said compressor in order to control at least one of said control parameters.

22. The controller device according to claim 21 wherein said control signals maintain said predeterminable capacity at a maximum energy quotient for said gas compressor and engine unit.

23. A method of predicting impending gas compressor and engine unit failures, the steps comprising:

(a) sensing the values of a set of operating and control parameters at determinable intervals;

(b) determining a first energy quotient for said unit, from said operating and control parameters, wherein said determination is based upon a calculated capacity of gas flow from said compressor;

(c) comparing said first energy quotient with a second pre-determined standard energy quotient; and (d) shutting said unit down with a difference between said energy quotient values exceeds a predetermined value.

24. A method of controlling at least two gas compressor and engine units combined in series for multiple-stage operation, the steps comprising:

(a) adjusting an engine speed and a compressor loading for each of said units so that an equivalent capacity of gas flow from each compressor is achieved; and (b) readjusting said engine speeds and said compressor loadings so that a predeterminable inter-stage pressure is maintained.

* * * * *

UNITED STATES PATENT AND TRADEMARK OFFICE

CERTIFICATE OF CORRECTION

PATENT NO. : 4,330,237

DATED : 5/18/82

INVENTOR(S) : Husam Battah

It is certified that error appears in the above—identified patent and that said Letters Patent is hereby corrected as shown below:

Column 9, line 21,

"last" should be --least--.

Column 14, line 20,

"with" should be --when--.

Signed and Sealed this

*Fifth* Day of *October 1982*

[SEAL]

*Attest:*

GERALD J. MOSSINGHOFF

*Attesting Officer*

*Commissioner of Patents and Trademarks*